US005269820A

United States Patent [19]

Fujii et al.

[11] Patent Number: 5,269,820

[45] Date of Patent: Dec. 14, 1993

[54] METHOD FOR SURFACE TREATMENT OF PLASTIC MATERIAL AND APPARATUS USED THEREFOR

[75] Inventors: Yasuhiro Fujii, Ninomiya; Osamu Iwase, Nagoya; Masayoshi Ichikawa; Kazushige Miyake, both of Hiratsuka; Hideo Terasawa, Zushi, all of Japan

[73] Assignee: Kansai Paint Co., Ltd., Hyogo, Japan

[21] Appl. No.: 963,708

[22] Filed: Oct. 20, 1992

[30] Foreign Application Priority Data

Oct. 25, 1991 [JP] Japan ..... 3-306778
Mar. 27, 1992 [JP] Japan ..... 4-100172

[51] Int. Cl.[5] ..... B24D 3/00
[52] U.S. Cl. ..... 51/293; 51/295
[58] Field of Search ..... 51/293, 295, 298; 427/427

[56] References Cited

U.S. PATENT DOCUMENTS 3,628,295 12/1971 Curtiss ..... 54/319
4,047,903 9/1977 Hesse et al. ..... 51/295
4,457,766 7/1984 Caul ..... 51/298
4,644,703 2/1987 Kaczmarek et al. ..... 51/298
4,773,920 9/1988 Chasman et al. ..... 51/295
5,014,468 5/1991 Ravipati et al. ..... 51/295

FOREIGN PATENT DOCUMENTS 830777 3/1960 United Kingdom .

*Primary Examiner*—Mark L. Bell
*Assistant Examiner*—W. Thompson
*Attorney, Agent, or Firm*—Wenderoth, Lind & Ponack

[57] ABSTRACT

Using a treating solution which is easy to dispose after use, the surface of a plastic material is treated so that the treated surface has good adhesion to a coating film to be formed thereon. An aqueous dispersion containing an abrasive which is harder than a plastic material to be surface-treated, is pressurized to about 1.0–200 kg/cm$^2$ and then is injected onto the surface of said plastic material through an injection nozzle. An airless spray gun having said injection nozzle is supported by a polyaxis type or articulated type robot. Thus, the surface of a plastic material is ground and converted into a rough surface and then coatings are applied thereon.

5 Claims, 2 Drawing Sheets

METHOD FOR SURFACE TREATMENT OF PLASTIC MATERIAL AND APPARATUS USED THEREFOR

BACKGROUND OF THE INVENTION

1. Field of the Invention

The present invention relates to a method for surface treatment of plastic material, which is preferable in view of the preservation of global environment, which is easy in disposal of the treating solution used and in which the plastic material after surface treatment can have a rough surface having good adhesion to a coating film to be formed thereon, as well as to an apparatus used for the method.

2. Description of Related Art

In coating plastic materials used in the bumper, fascia, fender, etc. of automobile, it has been widely conducted to subject said plastic materials to vapor cleaning with, for example, trichloroethane in order to clean their surfaces and allow them to have good adhesion to coating films to be formed thereon. The use of trichloroethane, however, has become, in recent years, an object of regulation in view of the preservation of global environment. As a measure for this regulation, cleaning with an acidic or alkaline cleaning solution is under way using a sprayer comprising a large number of stationary headers and a large number of spray nozzles fitted to the headers (this sprayer is the same type as generally used in surface treatment of metals). This cleaning method, however, has various problems. That is, the pump capacity is large; the power consumption is high; the cleaning solution tank is large; the amount of the cleaning solution used is large; and the surface of the plastic material after cleaning tends to show insufficient and unstable adhesion to a coating film to be formed thereon.

SUMMARY OF THE INVENTION

The present invention has been made in order to solve the above problems. The feature of the present invention lies in treating the surface of a plastic material by a particular means, prior to applying coatings to the surface. That is, the present invention relates to a method for surface treatment of plastic material, which comprises injecting, onto the surface of a plastic material, an aqueous dispersion containing an abrasive which is harder than the plastic material, at a high pressure to grind and remove the surface layer of the material to form a uniform rough surface, as well as to an apparatus used for said method.

According to the present invention, there is provided, in order to solve the above-mentioned problems, a method for surface treatment of plastic material, which comprises injecting, onto the surface of a plastic material, an aqueous dispersion containing an abrasive which is harder than the plastic material, to grind the surface and convert the surface into a rough surface.

According to the present invention, there is further provided, in order to solve the above-mentioned problems, an apparatus for surface treatment of plastic material, which comprises a surface treatment chamber, a pump for applying a pressure of about 1.0–200 kg/cm$^2$ to an aqueous dispersion containing an abrasive which is harder than a plastic material to be surface-treated, an airless spray gun connected to said pump and equipped with an injection nozzle for injecting said aqueous dispersion pressurized by said pump, onto the surface of said plastic material in said surface treatment chamber, and a polyaxis type or articulated type robot for supporting said airless spray gun.

According to the present invention, there is furthermore provided, in order to solve the above-mentioned problems, an apparatus for surface treatment of plastic material, which comprises a surface treatment chamber, a pump for applying a pressure of about 1.0–200 kg/cm$^2$ to an aqueous dispersion containing an abrasive which is harder than a plastic material to be surface-treated, an aqueous dispersion tank for recovering and storing the aqueous dispersion injected by said nozzle, a shower nozzle for spraying said aqueous dispersion onto the inner surface of said surface treatment chamber to prevent the abrasive from being deposited on the inner surface, jet nozzles for circulating said aqueous dispersion in said aqueous dispersion tank to prevent the abrasive from being settled in the tank, and pumps for sending the aqueous dispersion stored in the aqueous dispersion tank, into the shower nozzle and the jet nozzles.

In the present invention, the plastic material to be surface-treated includes plastics used in, for example, the outer panels (e.g. bumper, fascia, fender) of automobile, such as polyolefin, polypropylene, polyurethane, polyamide, ABS (acryl-butadiene-styrene), AES (acryl-ethylene-styrene), polyester, PPO (polyphenylene oxide), PC (polycarbonate), unsaturated polyester, PPO/PC alloy, ABS/PC alloy and the like. Each of these materials is molded to an intended shape and size prior to the surface treatment.

The abrasive is used to grind the surface of the plastic material and is preferably a powdery particulate. Specific examples of the abrasive are inorganic abrasives such as clay ($Al_2O_3.2SiO_2.2H_2O$), diatomaceous earth ($SiO_2.nH_2O$), silica ($SiO_2$), white carbon ($xSiO_2.CaO.nH_2O$), talc ($3MgO.4SiO_2.H_2O$), barium sulfate ($BaSO_4$), magnesium carbonate compounds ($3MgCO_3.4SiO_2.4H_2O$), barium carbonate ($BaCO_3$), calcium carbonate ($CaCO_3$), titanium dioxide ($TiO_2$), aluminum and the like. As the abrasive, there are also preferred glass beads (hollow glass beads are included), powders or particles of plastics (e.g. acrylic resin, epoxy resin, nylon, fluororesin, silicon resin), etc.

The shape and size of the abrasive have no particular restriction; however, the shape is preferably spherical, angular or scaly and the size is preferably 1–500$\mu$, particularly preferably 1–50$\mu$.

The abrasive can be appropriately selected depending upon the kind of the plastic material to be surface-treated. Basically, it must be harder than the plastic material; when it is softer than the plastic material, the surface grinding according to the present invention is difficult, making it impossible to achieve the object of the present invention.

The abrasive-containing aqueous dispersion used in the present invention can be obtained by dispersing the abrasive in water. The content of the abrasive in the aqueous dispersion can be appropriately varied depending upon the purpose of surface treatment, the size and specific gravity of the abrasive, etc.; however, the content is preferably about 5–50% by volume, particularly 10–30% by volume in view of the injectability onto plastic material, pressure transferability through pipe, recoverability, etc. of the aqueous dispersion. The aqueous dispersion may further contain, as necessary, a dispersant, a surfactant, an anti-settling agent, etc. The viscosity of the aqueous dispersion is preferably 1–3,000 cp, particularly 1–1,000 cp. This viscosity is required in order for the aqueous dispersion to have a fluidity enabling the injection and atomization, pressure transfer through pipe or hose, recovery, etc. of the aqueous dispersion.

In injecting the aqueous dispersion onto the surface of the plastic material, it is not requisite to subject the surface to a pretreatment such as degreasing, cleaning or the like. The injection can be conducted, for example, by pressure-transferring the aqueous dispersion and injecting the aqueous dispersion through the small-diameter nozzle of a sprayer such as airless spray coater, air-assisted spray coater or the like. The injection is preferably conducted under the conditions of, for example, nozzle tip diameter =0.5–2.0 mm, dispersion pressure =1.0–200 kg/cm$^2$, preferably 20–150 kg/cm$^2$, injection distance between nozzle and plastic material =50–150 mm and times of spraying =2–10.

In the present invention, it is necessary to inject the abrasive-containing aqueous dispersion onto the surface of the plastic material, allow the abrasive to collide with said surface, thereby grind and remove the surface layer of the plastic material to form a new rough surface. It is preferable to remove the surface layer uniformly in a specific thickness of 1$\mu$ or more, particularly 1–100$\mu$.

It is also necessary that the surface of the plastic material after grinding be a rough surface and not mirror surface. The surface after grinding preferably has specific roughnesses of center-line roughness (Ra)=0.03–0.5$\mu$, particularly 0.06–0.3$\mu$, ten-point average roughness (Rz)=0.2–5.0$\mu$, particularly 0.5–2.5$\mu$ and average mountain-to-mountain distance (Sm) =5.0–220.0$\mu$, particularly 20.0–170.0$\mu$, as measured by a surface roughness tester of contact feeler type (Surfcom 550A manufactured by Tokyo Seiki.

After injection of the aqueous dispersion, it is preferable to, as necessary, wash the surface of the plastic material with deionized water or tap water to remove the abrasive, etc. remaining on the surface, followed by drying of the surface.

The surface of the plastic material, which has been treated according to the present method, is coated with ordinary coatings for plastics, according to an ordinary method. Specifically, the surface is preferably coated first with a primer and then with a top coating. The primer can be appropriately selected depending upon the kind of the plastic material; for example, a primer composed mainly of an olefinic resin is preferably used for a polypropylene material, and a urethane resin type primer is preferably used for a polyurethane material. The top coating is preferably a one-pack type or multipack type coating containing, as a vehicle main component, an acrylic resin-amino resin system, a polyester resin-amino resin system or an acrylic resin (or polyester resin)-polyisocyante compound (blocked polyisocyanate is included) system; however, the top coating is not restricted to them. They are used after having been dissolved or dispersed in an organic solvent and/or water. The resulting solution or dispersion can be coated and dried (cured) according to know methods.

DESCRIPTION OF THE PREFERRED EMBODIMENTS

Figure 1:
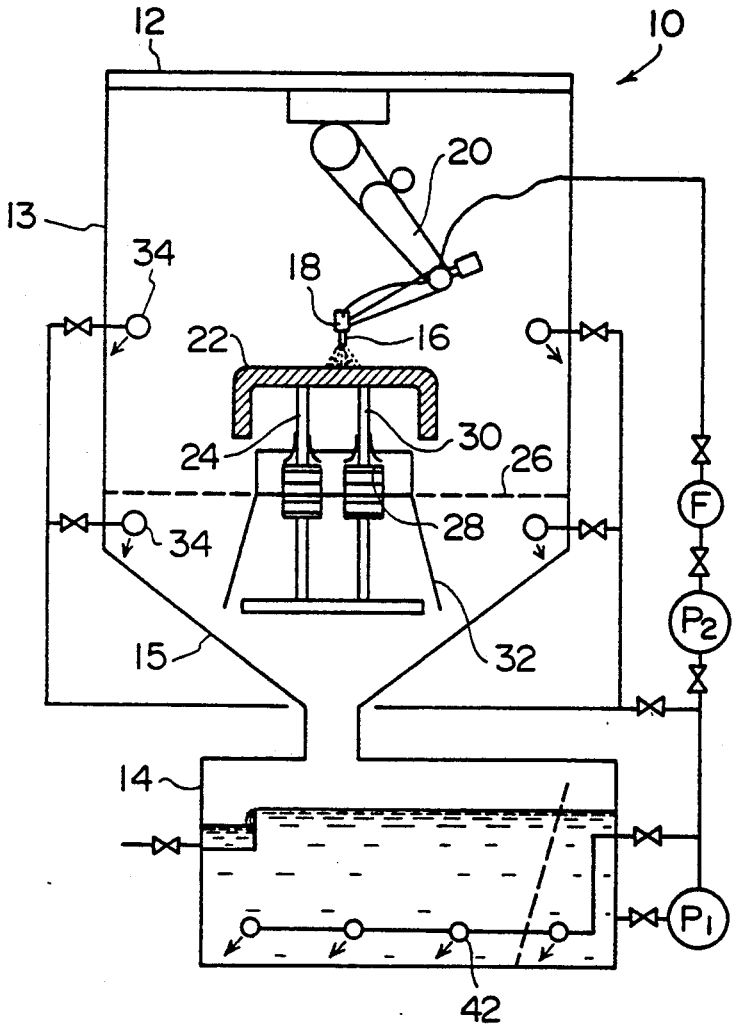
FIG. 1 is a schematic side view showing a first embodiment of the surface treatment apparatus of the present invention.

The following is a description of the apparatus for surface treatment plastic material according to the present invention, referring to a preferred embodiment of the present apparatus shown in FIG. 1.

In FIG. 1, the surface treatment apparatus 10 comprises a surface treatment chamber 12 and a treating solution tank 14 for recovering and storing a treating solution.

The surface treatment chamber 12 comprises an upper portion having a side wall 13 and a lower portion which is a hopper 15.

In the surface treatment chamber 12 is provided an airless spray gun 18 having one or more injection nozzles 16 for injecting a treating solution. The injection nozzle(s) 16 has (have) a hard nozzle tip made of tungsten carbide or a ceramic. The airless spray gun 18 is supported by the manipulator of an articulated robot 20 fixed to the ceiling of the surface treatment chamber 12. The articulated robot 20 moves the airless spray gun according to the information inputted to the robot beforehand. As the robot, there can be used not only an articulated type but also a polyaxis type or an articulated and polyaxis type.

In the surface treatment chamber 12 is further provided a conveyor 24 for supporting a plastic material to be surface-treated, for example, an automobile bumper 22. The conveyor 24 is supported in the surface treatment chamber 12 by a grating 26 an angle steel (not shown) supporting the grating.

The conveyor 24 comprises chain conveyors 28 which move intermittently or continuously and supporting frames 30 fixed to the chain conveyors 28. The automobile bumper 22 is supported on the supporting frames 30. Further, a conveyor cover 32 is provided in order to prevent the belts 28 from being wetted with a treating solution.

Figure 2:
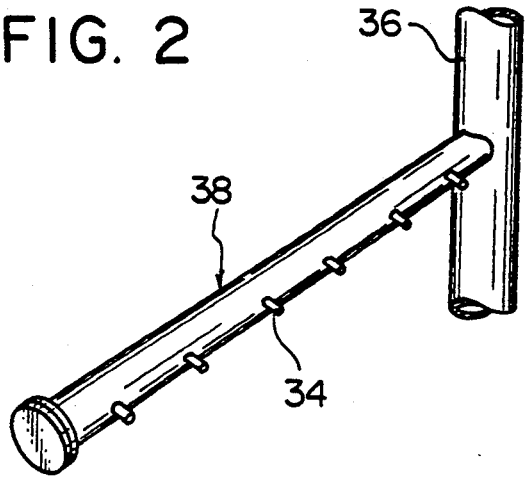
FIG. 2 is a perspective view showing an example of the shower nozzle as part of the surface treatment apparatus of FIG. 1.

In the surface treatment chamber 12 is furthermore provided a shower nozzle 34 for spraying a treating solution onto the inner surfaces of the side wall 13 and the hopper 15. The shower nozzle 34 can be constituted by, for example, a plurality of nozzles 34 connected to a header 38 communicating with a pipe 36, as shown in FIG. 2.

In the treating solution tank 14 are provided Stirring nozzles 42 for stirring a recovered and stored treating solution and preventing the abrasive contained in the treating solution from being settled.

Into the injection nozzle 16 is sent a treating solution pressurized to about 1.0–200 kg/cm$^2$, from the treating solution tank 14 via a first pump P1, a second pump P2 and a filter F. The treating solution is injected onto the automobile bumper 22 through the injection nozzle 16. Since the treating solution contains an abrasive, the first pump P1 and the second pump P2 are preferably each a high-pressure turbine pump, a diaphragm pump or the like, all having no sliding surface.

Into the shower nozzle 34 is sent a treating solution from the treating solution tank 14 via the first pump P1. The treating solution is sprayed from the shower nozzle 34 onto the inner surfaces of the side wall 13 and the hopper 15 to prevent the abrasive contained in the treating solution from being deposited on the inner surfaces of the side wall 13 and the hopper 15.

Into the stirring nozzles 42 is sent a treating solution from the treating solution tank 14 via the first pump P1. The treating solution is constantly injected from the stirring nozzles 42; thereby, the treating solution in the treating solution tank is stirred, the settling of the abrasive contained in the treating solution is prevented, and the treating solution is kept uniformly.

The surface treatment apparatus 10 is operated as follows.

First, the articulated robot 20 is allowed to memorize, in advance, the locus, speed, etc. of movement of the injection nozzle 16, suitable for the plastic material to be treated.

Works (plastic materials to be treated) of substantially same shape and size and of same production lot are intermittently or continuously passed through the surface treatment apparatus 10 by the conveyor 24.

When each of the plastic materials to be treated is carried to a given position, the articulated robot 20 moves the injection nozzle 16 according to the previously inputted information such as locus, speed, etc. of movement; the injection nozzle 16 injects a treating solution uniformly onto the whole area of the to-be-treated surface of the plastic material with the nozzle-plastic material distance being kept substantially constant; as necessary, this injection is conducted more than once.

The treating solution injected from the injection nozzle 16 in the treating solution chamber 12 is returned to the treating solution tank 14 along the side wall 13 and the hopper 15 constituting the lower portion of the surface treatment chamber 12. However, no abrasive in the treating solution remains on the inner surfaces of the side wall 13 and the hopper 15 because the shower nozzle 34 sprays the treating solution onto the inner surfaces of the side wall 13 and the hopper 15. Further, the treating solution in the treating solution tank 14 is kept uniformly by the stirring nozzles 42 provided in the tank 14.

The plastic material treated in the surface treatment apparatus 10 is, as necessary, washed in the next step by being passed through a high-pressure water washing zone, to sufficiently remove the abrasive, grinding refuse, etc. remaining on the treated surface so that the coating film to be formed later on the treated surface gives rise to no problems such as poor adhesion, poor finish and the like.

Figure 3:
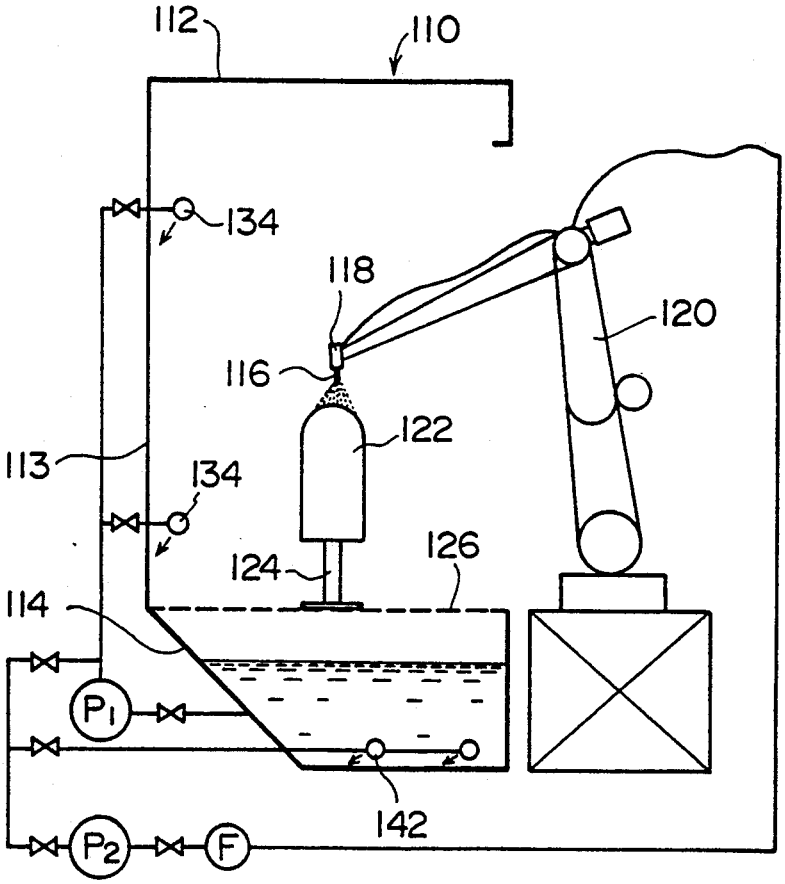
FIG. 3 is a schematic side view showing a second embodiment of the surface treatment apparatus of the present invention.

Then, the apparatus for surface treatment of plastic material according to the present invention is described, referring to a second embodiment as shown in FIG. 3.

The surface treatment apparatus 110 comprises a surface treatment chamber 112 and a treating solution tank 114 for recovering and storing a treating solution.

In the surface treatment chamber 112 is provided an airless spray gun 118 equipped with injection nozzle(s). The airless spray gun 118 is supported by an articulated robot 120 fixed to a member provided outside the surface treatment chamber 112. In the surface treatment chamber 112 is further provided a conveyor 124 for supporting, for example, an automobile bumper 122. This conveyor 124 is supported by a grating 126 and an angle steel (not shown) supporting the grating 126, in the surface treatment chamber 112.

In the surface treatment chamber 112 is furthermore provided a shower nozzle 134 for spraying a treating solution onto the inner surface of a side wall 113.

In the treating solution tank 114 are provided stirring nozzles 142 for stirring a recovered and stored treating solution.

The surface treatment apparatus 110 is operated similarly to the surface treatment apparatus 10 shown in FIG. 1.

When the above-mentioned aqueous dispersion is injected onto the surface of a plastic material according to the surface treatment method of the present invention, the surface layer of the plastic material is ground and simultaneously the oily matter, releasing agent, etc. adhering onto said surface are removed. This injection is simple because it is conducted at atmospheric temperature in a short time. Further, microscopic observation of the rough surface after grinding indicates that the grinding is conducted in dots and the surface after grinding is in a matter condition. As a result, the surface after grinding has improved wettability to coatings and improved adhesion to coating films formed thereon. Furthermore, in the surface treatment of plastic material according to the present invention, there is used no substance (e.g. trichloroethane) which deteriorates the global environment. Moreover, there is used neither acid component nor alkaline component. In addition, in the present invention, the aqueous dispersion is reusable by removing the oily matter, releasing agent, grinding refuse, etc. contained therein; hence the present invention gives rise to substantially no environmental pollution.

EXAMPLE 1

An automobile bumper made of a polypropylene material was subjected to a surface treatment with an abrasive-containing aqueous dispersion type treating solution using an automatic airless spray gu, in a chamber as shown in FIG. 3. The abrasive-containing aqueous dispersion type treating solution was prepared by dispersing 10% by volume of a clay powder (particle size $=1-20\mu$) in water and adding thereto 5 weight % of a surfactant of straight-chain alkylbenzene type. The automatic airless spray gun was equipped with an airless nozzle tip [163–643 manufactured by Nikon Gray Company (Japan) (nominal diameter=1.09 m)] and fitted to a coating robot (Otegarukun manufactured by Iwata Air-compressor Mfg. Co., Ltd.). The treating solution was injected onto the whole surface of the bumper uniformly six times, at an injection pressure of 70 $kg/cm^2$ (a bumper surface pressure of 10–50 $kg/cm^2$) generated using a three-diaphragm type pump [25HY manufactured by Nikuni Kikai Kogyo Co., Ltd.] while the bumper surface-airless spray gun distance and the gun-travelling speed were being kept at 50–80 mm and 30 re/min, respectively, according to the information previously inputted to the robot. In FIG. 3 are shown the outline of the surface treatment apparatus used in Example 1. The treated surface was then washed with deionized water and dried at 80° C. for 10 minutes. The resulting surface was uniformly rough, clean and matte. Its surface roughnesses as measured by Surfcom 550A (measurement distance=1 Mm and measurement magnification=10,000) were Ra $0.17\mu$ ($0.06\mu$), Rz$=1.42\mu$ (0.46μ) and Sm=44μ (181μ) (the values in parentheses are surface roughnesses before grinding). The cut-off before grinding was 0.025 mm or more and the cut-off after grinding was 0.08 mm or more.

The above-treated surface of the polypropylene material was coated with a primer of olefinic elastomer resin type [SOFLEX No. 2500 (trade name) manufactured by KANSAI PAINT CO., LTD.] so as to give a coating film of 15μ (as dried) in thickness. The coated primer was dried at 80° C. for 30 minutes. Then, there was coated a top coating which was a 70:30 (by weight) mixture of a polyester-urethane resin system [SOFLEX No. 200 (trade name) manufactured by KANSAI PAINT CO., LTD.] and a curing agent of polyisocyanate compound type [SOFLEX CURING AGENT (trade name) manufactured by KANSAI PAINT CO., LTD.], so as to give a coating film of 30μ (as dried) in thickness. The coated top coating was dried at 80° C. for 30 minutes.

EXAMPLE 2

A bumper made of a PU (polyurethane resin), formed by reaction injection molding was subjected to the same surface treatment as in Example 1. The surface roughnesses of the treated surface of the bumper were measured in the same manner as in Example 1 and were Ra=0.07 (0.06 ), Rz=0.60μ (0.50μ) and Sm=160μ (175μ) (the values in parentheses are surface roughnesses before grinding). On the above-treated surface was coated a primer of urethane elastomer resin type [SOFLEX No. 1000 (trade name) manufactured by KANSAI PAINT CO., LTD.] so as to give a coating film of 15μ (as dried) in thickness. The coated primer was dried at 80° C. for 30 minutes. Thereon was coated the same top coating in the same manner as in Example 1.

EXAMPLE 3

The procedure of Example 1 was repeated except that the clay in the aqueous dispersion was changed to alumina [an aluminum oxide powder having particle diameters of 1–15μ (average particle diameter=4μ)]. The surface roughnesses after grinding, which were measured in the same manner as in Example 1, were Ra=0.11μ, Rz=0.90μ and Sm=44μ. The surface roughnesses before grinding are shown in Example 1.

COMPARATIVE EXAMPLE 1

Onto the surface of the same polypropylene material as used in Example 1 was injected an aqueous solution of 60° C. obtained by dissolving an acidic cleaning solution [ID 112 (trade name) manufactured by TOSOH CORPORATION] in water in a 4% concentration, at a pressure of 2 kg/cm$^2$ for 90 seconds. The resulting surface was washed with deionized water and dried at 80° C. for 10 minutes. The subsequent coating was conducted in the same manner as in Example 1.

COMPARATIVE EXAMPLE 2

The surface of the same PU material as used in Example 2 was subjected to the same treatment and coating as in Comparative Example 1.

COMPARATIVE EXAMPLE 3

The surface of the same PP material as used in Example 1 was subjected to vapor cleaning (70° C. and 60 seconds) with 1,1,1-trichloroethane. The resulting surface was subjected to the same coating as in Example 1.

COMPARATIVE EXAMPLE 4

The surface of the same PU material as used in Example 2 was subjected to the same vapor cleaning as in Comparative Example 3. The resulting surface was subjected the same coating as in Example 2.

RESULTS OF PERFORMANCE TESTS

The coated materials obtained in Examples and Comparative Examples were evaluated for coating film performances. The results are shown in Table 1.

TABLE 1

| | Example | | | Comparative Example | | | |
|---|---|---|---|---|---|---|---|
| | 1 | 2 | 3 | 1 | 2 | 3 | 4 |
| Initial adhesion | 100 | 100 | 100 | 10 | 20 | 100 | 100 |
| Adhesion in water presence | 100 | 100 | 100 | 0 | 0 | 100 | 50 |
| Environmental preservation | | | | | | | |
| Air | Good | Good | Good | Good | Good | Poor | Poor |
| Waste water | Good | Good | Good | Poor | Poor | Poor | Poor |

TEST METHODS

Initial adhesion: Cross-cutting was applied onto the coating film formed on a plastic material with a cutter knife to form 100 squares, 1mm×1mm. A pressure-sensitive cellophane tape was adhered onto the coating film and then the tape was peeled off. The initial adhesion of the film was expressed by the number of remaining film portions.

Adhesion in water presence: A plastic material having a coating film formed thereon was immersed in hot water of 400° C. for 240 hours and then air-dried. The resulting material was measured for adhesion in the same manner as above.

What is claimed is:

1. A method for preparing the surface of a plastic material so that a coating film will have good adhesion thereto without the use of environmentally hazardous cleaning chemicals which method comprises the steps of:

spraying the surface of the plastic material with an aqueous dispersion containing 5 to 50% by volume of an inorganic abrasive having a size of 1–50μ, which abrasive is harder than the plastic material, at a pressure of 1.0–200 kg/cm$^2$, to grind the surface to a rough surface.

2. The method according to claim 1, wherein the surface is ground to a center-line roughness (Ra)=0.-0.3–0.5μ, a ten-point average roughness (Rz)=0.2–5.0μ, and an average mountain-to-mountain distance (Sm)=5.0–220.0μ, as measured by a Surfcom 550A surface roughness tester manufactured by Tokyo Seiki.

3. The method according to claim 1, wherein the plastic material is selected from the group consisting of polyolefin, polypropylene, polyurethane, polyamide, AES (acryl-ethylene-styrene), polyester, PPO (polyphenylene oxide), PC (polycarbonate), unsaturated polyester, polyphenylene oxide/polycarbonate alloy and acryl-butadiene-styrene/polycarbonate alloy.

4. A method according to claim 3, wherein the plastic material is an outer panel of an automobile.

5. The method according to claim 1, wherein the inorganic abrasive is selected from the group consisting of clay, diatomaceous earth, white carbon, talc, barium sulfate, magnesium carbonate compound ($3MgCO_3.4SiO_2.H_2O$), barium carbonate, calcium carbonate, titanium dioxide and aluminum powder.

* * * * *